US011596966B1

(12) United States Patent
Wellner

(10) Patent No.: US 11,596,966 B1
(45) Date of Patent: Mar. 7, 2023

(54) IRRIGATION SYSTEM PROTECTION DEVICE AND METHOD OF USE

(71) Applicant: Richard Wellner, Parkland, FL (US)

(72) Inventor: Richard Wellner, Parkland, FL (US)

( * ) Notice: Subject to any disclaimer, the term of this patent is extended or adjusted under 35 U.S.C. 154(b) by 0 days.

(21) Appl. No.: 17/675,719

(22) Filed: Feb. 18, 2022

(51) Int. Cl.
*B05B 15/16* (2018.01)

(52) U.S. Cl.
CPC ..... *B05B 15/16* (2018.02)

(58) Field of Classification Search
CPC ..... B05B 15/16; B05B 15/14; G01F 15/10; G01F 15/14; E03B 7/095; Y10T 137/6991; Y10T 403/7007; Y10T 403/60; F16L 37/133; F16L 37/24; F16B 7/0406; F16B 21/06; F16B 21/08; F16B 21/09; F16B 21/084; Y10S 403/14
See application file for complete search history.

(56) References Cited

U.S. PATENT DOCUMENTS 5,213,262 A 5/1993 Violette
5,353,571 A * 10/1994 Berdan ..... B60R 13/04 52/716.5
5,702,056 A 12/1997 Yang
6,494,386 B1 12/2002 Banu
6,543,704 B2 4/2003 Stephens
10,335,821 B2 7/2019 Schneider
10,919,068 B1 * 2/2021 Newmeyer ..... B05B 15/622
2009/0084869 A1 4/2009 Lin
2009/0173397 A1 * 7/2009 Mallela ..... F16L 5/00 137/364
2014/0362560 A1 * 12/2014 Formico ..... F21V 15/01 239/302
2017/0095826 A1 * 4/2017 Schneider ..... B05B 15/16

* cited by examiner

*Primary Examiner* — Tuongminh N Pham
(74) *Attorney, Agent, or Firm* — Steven A. Maynard

(57) ABSTRACT

A protection device for an irrigation system having at least one water line and at least one irrigation sprinkler head, the protection device comprising a protector body having a wall defining an interior cavity, a top rim, and a bottom rim with at least two groove pairs, wherein a first groove pair has a first groove profile, and a second groove pair has a second groove profile, the second groove profile being different from the first groove profile, an adapter cap having an outer rim surface, an annular ledge extending inward from the outer rim surface, a bottom surface, and a top surface, the adapter cap detachably connected to the protector body, a collar insert having an outer edge, an inner edge defining a center aperture, and a lower surface, the collar insert detachably connected to the adapter cap, and wherein the protector body is selectively ridingly engaged between a first riding engagement with the first pair of grooves and a second riding engagement with the second pair of grooves on at least one water line.

18 Claims, 6 Drawing Sheets

IRRIGATION SYSTEM PROTECTION DEVICE AND METHOD OF USE

BACKGROUND OF THE INVENTION

Field of the Invention

This invention relates generally to the field of protection devices for protecting and stabilizing elements projecting from pipes, lines, conduits, etc. More specifically, the present disclosure is directed to protection devices for irrigation system components, such as sprinkler heads. The protection device advantageously protects the irrigation system components from contact damage and additionally provides a user with ease of access, enabling the user to handle and/or use tools to repair, replace, or adjust the component(s) contained within the protection device. This invention may be installed when the irrigation system component is first installed or as an added element to an existing irrigation system.

Description of the Related Art

Irrigation system components are generally used on farms, golf courses, and residential yards to provide water to lawns and plants. Typically, irrigation sprinkler heads are buried in the ground along with plumbing parts, pipelines, and control equipment. One or more sprinkler heads may be connected to the underground pipelines to receive water from an outflow valve. The sprinkler heads are typically managed by a user operating the control equipment such that the sprinkler heads "pop up" at predetermined times to spray water for preselected intervals. After such an interval, the sprinkler heads return to their original position beneath the ground.

A multitude of problems are encountered by users of lawn and garden sprinkler systems like damage to the sprinkler body and/or head as a result of some force acting against the sprinkler head such as an inadvertent kick by the shoe of passersby or children playing, being struck by a stray basketball from neighborhood kids, being run over by lawnmower, car, golf cart, etc., or other such forces. It would therefore be desirable to provide an irrigation system protection device that provides protection against damaging forces such as those encountered in the aforementioned scenarios.

Additionally, the sprinkler may be damaged by orientation or position if the ground shifts due to forces such as those described above, improper installation, or simply because of ground settling. For example, many new landscape installations use fresh top soil or have significant fill areas, and, over a period of time, the top soil or fill areas may settle and cause a shift or tilt in the sprinkler positioning. This may result in a brown spot in a watered lawn, because the sprinkler is prevented from providing its full spray pattern. Additionally, a sprinkler head with a 360-degree spray pattern may be tilted so that it sprays directly into the ground on one side while spraying up at an angle on the other side. Further, the user may try to compensate for the perceived lack of water in one zone by increasing the watering time at the controller for that zone, which does not solve the problem, wastes water and money, and may lead to erosion. Another related problem is that when the sprinkler is moved or otherwise disturbed, its setup and spray pattern may be inadvertently changed thereby rendering the sprinkler less effective. It would therefore be desirable to provide a device for irrigation system components that also maintains a desired sprinkler positioning or orientation with respect to surrounding top soil as set and intended by the user.

Finally, if a sprinkler is damaged or otherwise needs attention, much effort is required to access the sprinkler for replacement or modification. Currently when a sprinkler head requires maintenance, a working space of approximately 6 inches in diameter and approximately 6 inches in depth must be dug in the dirt around the base of the sprinkler head, usually all the way down to where it screws into the water supply line. This is a very messy and time consuming job, especially when the soil is rocky or contains roots which must be cut. When the bottom of the head and/or connection with the underground pipe are finally reached and unscrewed, the hole that has just been dug usually fills with water that is residual in the underground water supply lines, even if the main water source has been shut down. Muddy water, dirt and debris then fall into the now open water lines. Since the debris will likely clog the replaced head and/or water line if allowed to remain, the water must be bailed out of the hole or one must wait for the water to be absorbed back into the ground before work can be continued or completed. After the repair is made, the hole that is dug must be refilled with dirt. It is most aggravating when this procedure must be done all over again a short time later to repair another problem that might occur with the same head. When this scenario is multiplied by 15 to 25 sprinkler heads per yard this becomes a never-ending problem. It would therefore be desirable to provide an irrigation system protection device that also holds soil and other debris away from the sprinkler and thereby allow access to the sprinkler for easy, maintenance, repair, and replacement.

Over the years, numerous attempts have been made to protect irrigation system components and, more specifically, to prevent in-ground pop-up type sprinkler heads from being damaged. For example, so-called sprinkler guards, such as those commonly referred to as "donuts," have been developed to surround the sprinkler head. Such sprinkler guards are designed to either sit atop the ground surface or partially buried in the ground surface. Such sprinkler guards attempt to provide some degree of protection for the sprinkler head by providing a visual indicator to lawn maintenance personnel of the presence of a sprinkler head. However, it is well known that such products are ineffective when it comes to protecting the sprinkler head from inadvertent contact with lawn maintenance equipment. Furthermore, such products do not impede undesirable growth of grass over and/or adjacent to the sprinkler head. Further still, such visual type sprinkler guards are usually either free-standing or slightly inserted into the ground surface, and are thus highly susceptible to being dislodged and displaced, particularly when they are contacted by heavy lawn maintenance equipment and machinery.

More recent attempts at protecting irrigation system components include protective housing assemblies that are typically installed such that the majority of the assembly is below ground level. While these assemblies may offer increased stability over, say, the ubiquitous "donut" type devices, these assemblies suffer from difficulties in achieving an ideal elevation such that the top of a given assembly may protrude above ground level, thereby exposing the assembly to impact damage, or such that the top of a given assembly may set below ground level, making the installation unsightly, enabling the assembly to be inadvertently buried, and/or exposing the assembly to problems associated with divets, holes, etc. It is therefore desirable to provide an irrigation protection device as a solution to the aforementioned problems.

SUMMARY OF THE PRESENT INVENTION

The present disclosure is directed to an irrigation protection device for protecting and stabilizing irrigation system elements such as lawn and/or garden sprinklers/sprinkler heads which are attached to water lines. The irrigation protection device is intended to protect and stabilize irrigation system elements in a manner that provides a user easy access to an installed sprinkler and/or facilitates attachment of a sprinkler/sprinkler head to a subterranean water line. In one embodiment, the protection device includes a protector body having a cylindrical wall with open top and bottom. An adapter cap is affixable atop the cylindrical wall and seats a collar insert preselected to accommodate a least a portion of the sprinkler to stabilize the sprinkler. At its bottom, the protector body includes oppositely situated of pairs of grooves, which may selectively ridingly engage outlet and/or inlet water supply line(s) according to predetermined selection criteria to account for things such as tree root systems or large diameter water lines and to enable the user to adjust the height of the device with respect to ground level. Additionally, the protector body may accommodate a stabilizer ring within an interior of the cylindrical wall to provide additional stabilization of the sprinkler body.

A preferred method of using a protection device for an irrigation system having at least one water line and at least one irrigation sprinkler head includes the steps of placing a protector body around an irrigation sprinkler head, the protector body having a wall defining an interior cavity, a top rim with cap fixing elements, and a bottom rim with at least two pairs of grooves wherein a first pair of grooves has a first groove profile and a second pair of grooves has a second groove profile, the second groove profile being different than the first groove profile. Further, the preferred method includes attaching an adapter cap to the protector body, the adapter cap having an outer rim surface, an annular ledge extending inward from the rim surface, and a bottom surface with body fixing elements for attaching cap fixing elements for detachably connecting the protector body to the adapter cap and a top surface with collar fixing elements. Still further, connecting a collar insert to the adapter cap, the collar insert having an outer edge, an inner edge defining a center aperture, and a lower surface with fixing elements for detachably connecting the collar fixing elements to the adapter cap. Finally, selecting placement of the protector body between a first riding engagement with the first pair of grooves on the at least one water line or a second riding engagement with the second pair of grooves on the at least one water line, based on predetermined selection criteria.

BRIEF DESCRIPTION OF THE DRAWINGS

The invention will now be described, by way of example, with reference to the accompanying drawings, where like numerals denote like elements and in which.

DETAILED DESCRIPTION OF EXEMPLARY IMPLEMENTATIONS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 2. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
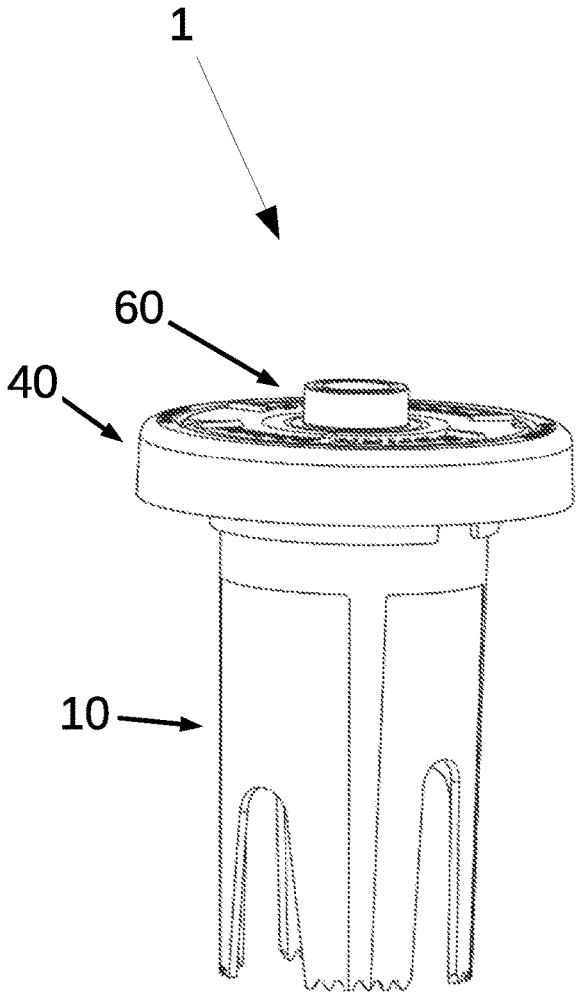
FIG. 1 presents a top left isometric view of an exemplary implementation of an irrigation protection device.
Figure 2:
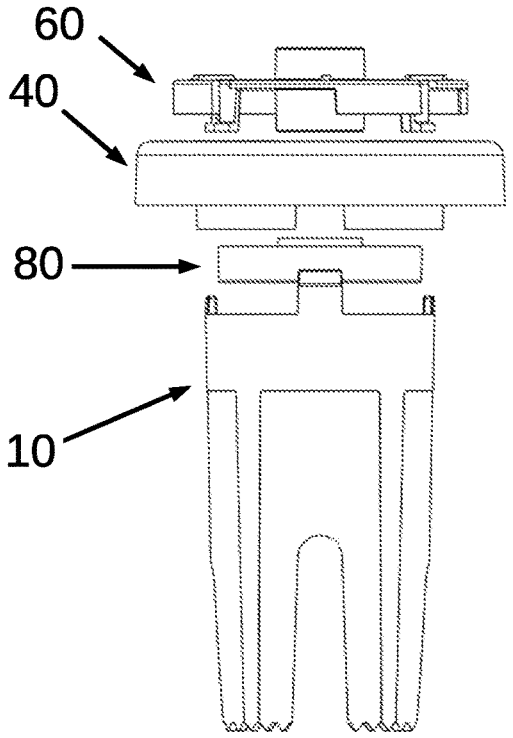
FIG. 2 presents an exploded front plan view of an irrigation protection device in accordance with an exemplary implementation of the instant invention.

Referring to FIGS. 1 and 2 in accordance with a first exemplary embodiment, an irrigation system protection device is shown generally as reference 1. Protection device 1 includes a protector body 10, an adapter cap 40, and a collar insert 60. In a preferred embodiment, protection device 1 includes stabilizer ring 80 which can be seen in FIG. 2. Protection device 1 is preferably made of a plastic, preferably a moldable plastic such as polypropylene, as known in the art.

Figure 3:
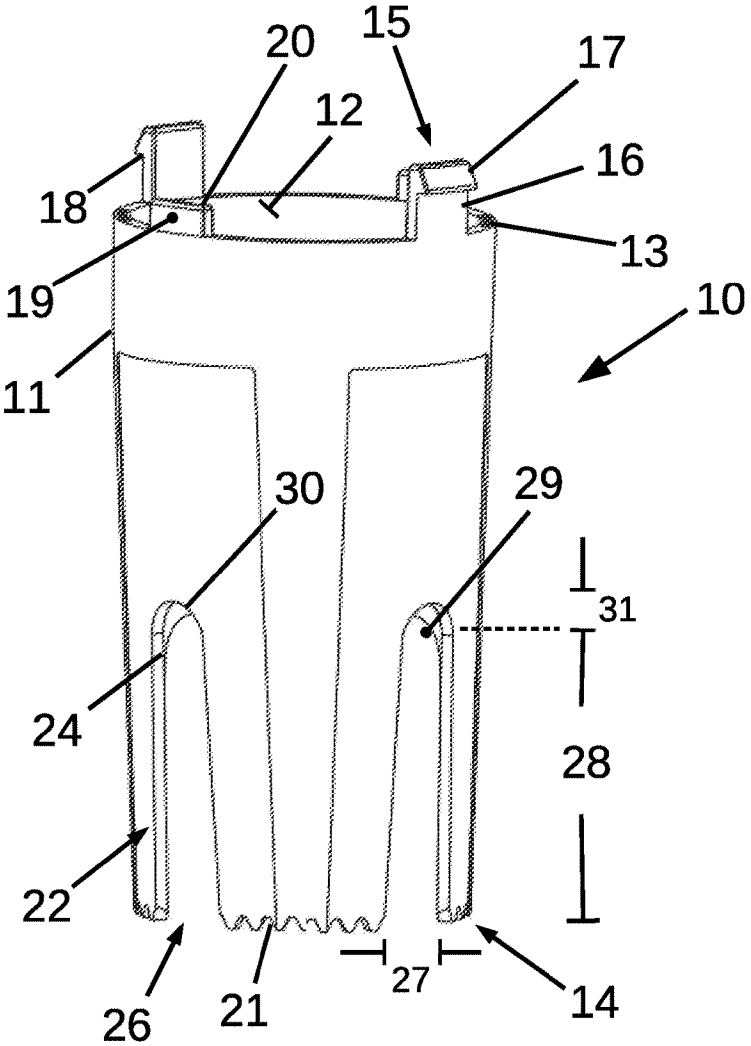
FIG. 3 presents a top left isometric view of a first protector body in accordance with an exemplary implementation of the instant invention.

As can be seen in FIG. 3, protector body 10 includes a wall 11 that is generally cylindrical in shape, defining an interior cavity 12, a top rim 13 and a bottom rim 14. Top rim 13 includes cap fixing elements 15 disposed thereon, which enables protector body 10 to be detachably joined with adapter cap 40. Cap fixing elements 15 preferably include projecting tabs 16 which project upward from top rim 13 and which each terminate in a beveled head 17 having an underside 18 which interfaces with elements of cap 40, as described below, when the aforementioned detachable connection of protector body 10 with adapter cap 40 is made. Cap fixing elements 15 preferably also include alignment tabs 19, each of which terminates at respective top surfaces 20, and which serve to further facilitate a detachable connection between the protector body 10 and adapter cap 40 such as in the manner described in detail below. It is noted that, in other embodiments, cap fixing elements 15 may include additional or alternate structures known in the art as being suitable for detachably joining together protector body 10 and adapter cap 40. For example, in place of alignment tabs 19, cap fixing elements 15 may include two additional projecting tabs for a total of four projecting tabs 16, mutatis mutandis. Preferably, at least a portion of bottom rim 14 of protector body 10 includes a serrated edge 21. The serrated edge 21 enables an installer/user to use the irrigation protection device 1 as an installation tool to clear a space for installation of the device 1 and/or other irrigation components.

In a preferred embodiment, wall 11 of generally cylindrical protector body 10 has a tapered profile such that a circumference of the bottom rim 14 is smaller than a circumference of the top rim 13. This tapered profile may assist the installer/user in removing dirt loosened by serrated edge 21 and/or in securing stabilizer ring 80 via an interference fit as explained in greater detail below.

Referring to FIG. 3, bottom rim 14 of protector body 10 includes first groove pair 22. A given groove pair may share a groove profile adapted to achieve a riding engagement with at least one tubular conduit, such as an irrigation system water line or a fitting therefore (e.g., union, coupler, elbow, adapter), though a groove pair having distinct profiles one from another are also envisioned (e.g., to accommodate differing inlet and outlet tubular conduit sizes). First groove pair 22 shares a single groove profile with all grooves depicted in the embodiment of FIG. 3. A preferred groove profile includes an arch having two edges that are generally symmetric with one another (i.e., along a vertical centerline of protector body 10), defining an opening 26 located along bottom rim 14 of protector body 10, and tapering toward one another, linearly extending toward top rim 13 of protector body 10 until both edges ultimately join in curve 30. Preferably, the groove profile 24 of a given groove is capable of accommodating a tubular conduit in a riding engagement. The phrase "riding engagement" is intended to convey that a groove accommodates a tubular conduit such that the conduit contacts at least a portion of the groove profile, preferably at the groove curve, thereby resisting lateral and torsional displacement of the device 1 with respect to the irrigation system components. Preferably, the riding engagement of at least one groove pair orients the protection device 1 with respect to the tubular conduit(s) such that top rim 13 of protection device 1 sits at a desired elevation with respect to ground level.

Figure 4:
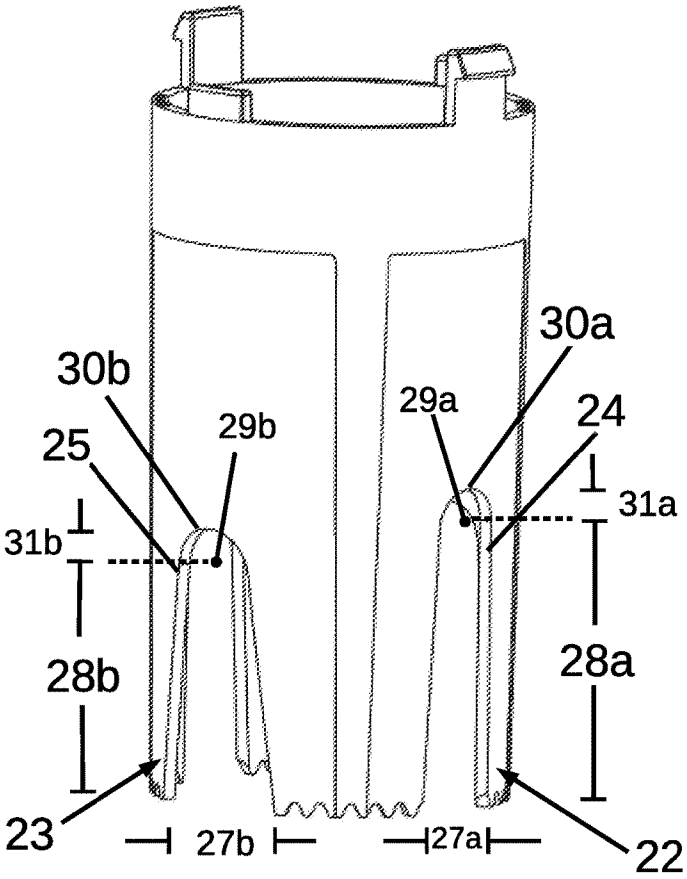
FIG. 4 presents a top left isometric view of a second protector body in accordance with an exemplary implementation of the instant invention.

The profile of a given groove may be at least partially defined by a width 27 of its opening 26 at bottom rim 14 of protector body 10, a height 28 above bottom rim 14 of center point 29 of the curve 30 that joins the edges of a groove profile, and radius of curvature 31 of curve 30. Groove profiles may be defined by additional or alternate parameters, such as a slope of the groove edges with respect to bottom rim 14 (i.e., for a screw-on type profile), a length of the groove edges, etc. As shown in FIG. 4, groove profiles are preferably distinct between groove pairs, meaning that one or more of the aforementioned parameters are different between groove profiles of different groove pairs, though it is envisioned that grooves of the same groove pair may have differing groove profiles. In this manner, a single protection device may accommodate a plurality of tubular conduit sizes, to include multiple tubular conduits with differing sizes, within the same installation (e.g., over a 4-way junction with multiple tubular conduits/fittings having differing outer diameters). A specific example of differing profiles is depicted in FIG. 4, where the arched profile of a first groove pair 22 of protector body 10 includes first width 27*a*, first height 28*a*, and first curve 30*a* with a first radius curvature 31*a* which differ in magnitude from second width 27*b*, second height 28*b*, and second radius of curvature 31*b* of second curve 30*b* of the arched profile of second groove pair 23. For example, the arched profile of first groove pair 22 may have a width 27*a* that is 1.5 inches along bottom rim 14, a height 28*a* that is 3 inches from bottom rim 14 to center point 29*a* of curve 30*a*, and a radius of curvature 31*a* that enables a riding engagement with a waterline of a size corresponding to a nominal PVC pipe outer diameter of ¼" (e.g., a 0.54" OD). In contrast, the arched profile of a second groove pair 23 may have a width 27*b* of 1.75 inches, a height 28*b* of 2 inches, and a radius of curvature 31*b* that enables a riding engagement with a waterline of a size corresponding to a nominal PVC pipe outer diameter of ½" (e.g., a 0.84" OD). Other profiles/shapes are envisioned, but the preferred embodiment enables installation of a sprinkler head such that, when the protector device 1 is installed, the sprinkler head is protected at or below ground level whenever the sprinkler head is not actively being employed in spraying water.

Figures 5, 6:
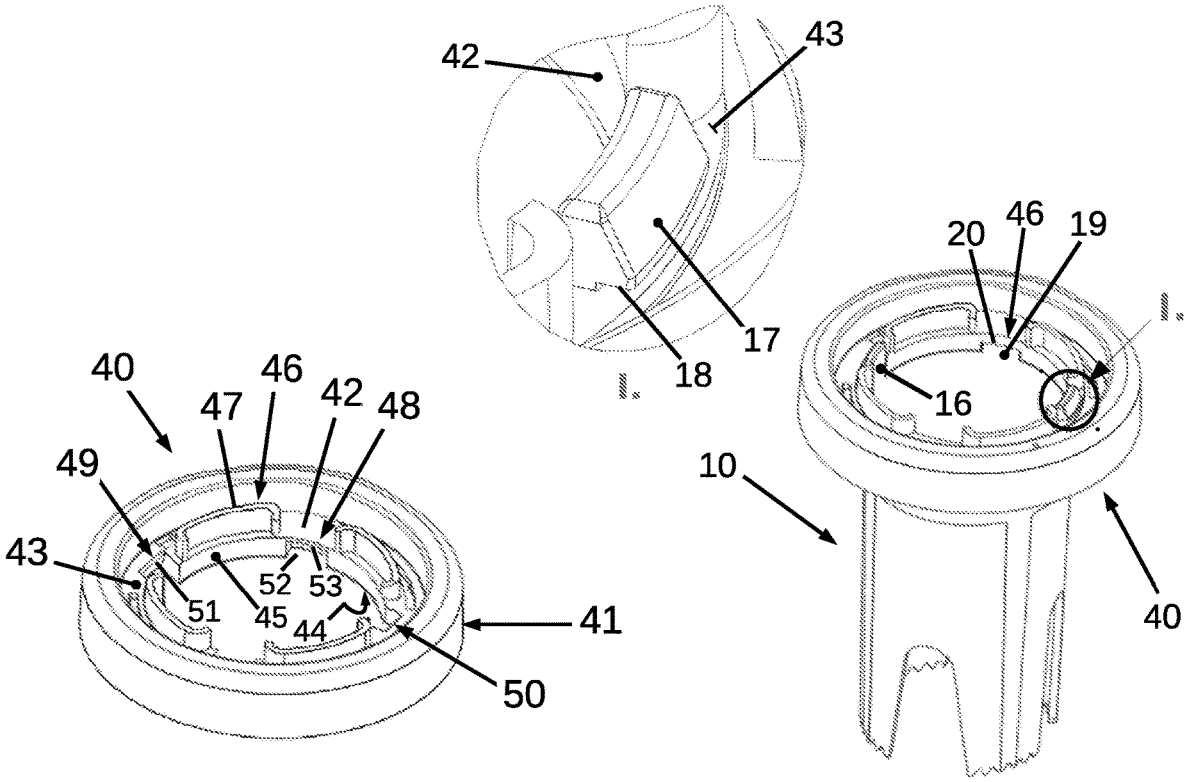
FIG. 5 presents a top left isometric view of a cap in accordance with an exemplary implementation of the instant invention.
FIG. 6 presents a top left isometric view of a protector body and installed cap in accordance with an exemplary implementation of the instant invention.

As can be seen in FIG. 5, adapter cap 40 is generally ring-shaped and is defined by outer rim 41. Adapter cap 40 extends inward from outer rim 41 to form annular ledge 42. Annular ledge 42 includes top and bottom surfaces 43 and 44, respectively, which terminate along inner edge 45. Annular ledge 42 extends upward to define arcuate standoffs 46 each of which terminate at respective contact edges 47. (The height of each arcuate standoff 46 should be at least the length typical of bevel heads 17 of protector body 10 to enable a detachable connection of cap 40 with collar insert 60, as described below, when cap 40 is detachably connected to protector body 10). Annular ledge 42 also extends downward to define body fixing elements 48. Body fixing elements 48 are adapted to accommodate cap fixing elements 15 of protector body 10 and thereby detachably secure cap 40 to protector body 10. In a preferred embodiment, the body fixing elements 48 of adapter cap 40 include beveled notches 49 which include notch openings 50 along annular ledge 42 that are beveled so as to join the top and outer walls of notch 49 to form bevel face 51. Body fixing elements 48 preferably also include alignment notches 52 each of which terminate at respective top faces 53 located below top surface 43.

A detachable installation of cap 40 with protector body 10 is preferably achieved via a "snap-fit" arrangement. Referring to FIGS. 5 and 6, a snap-fit installation for the instant invention is described. Body fixing elements 48 of cap 40, specifically beveled notches 49 and alignment notches 52, are aligned with cap fixing elements 15, specifically projecting tabs 16 and alignment tabs 19 of protector body 10, respectively. Cap 40 and protector body 10 are pressed together, causing beveled heads 17 of projecting tabs 16 to slide along and against corresponding bevel faces 51 of beveled notches 49. Projecting tabs 16 are thereby temporarily deflected toward the centerline of cap 40. During this pressing, cap 40 is partially rotationally constrained by projecting tabs 16 within beveled notches 49 as alignment notches 52 receive alignment tabs 19 and further rotationally constrain cap 40 with respect to protector body 10. After having fully pressed cap 40 against protector body 10, respective undersides 18 of beveled heads 17 pass and clear top surface 43 of annular ledge 42 of cap 40, and each projecting tab 16 "snaps" outward (i.e., away from center axis of cap 40), and respective undersides 18 of beveled heads 17 now rest against top surface 43 of annular ledge 42, and each top surface 20 of alignment tabs 19 is in contact or nearly in contact with respective top faces 53 of alignment notches 52. (Detaching of adapter cap 40 from protector body 10 may be performed by pressing beveled heads 17 of projecting tabs 16 toward the centerline of protector body 10, thereby deflecting projecting tabs 16 toward the centerline of protector body 10, while pulling protector body 10 and adapter cap 40 in opposite directions).

Figure 7:
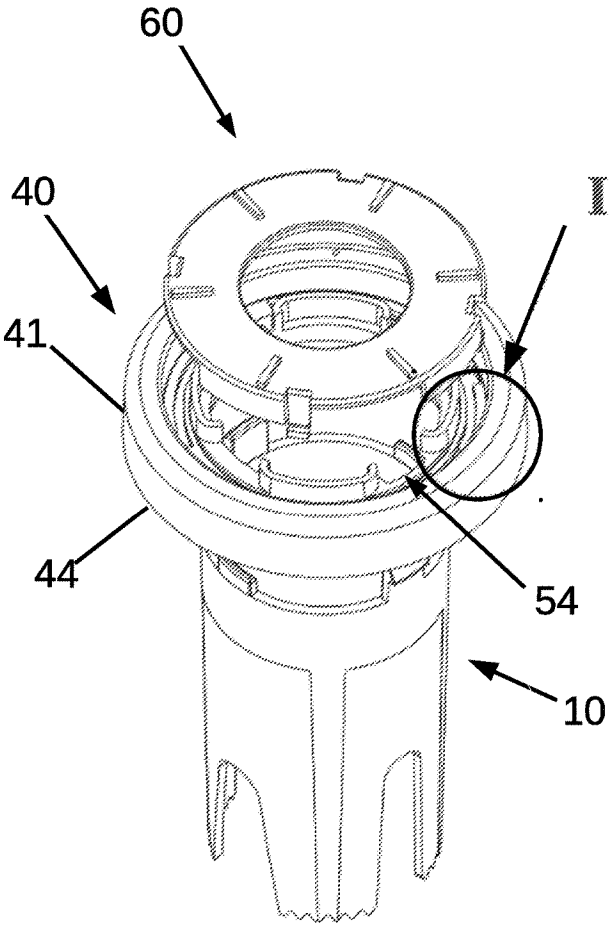
FIG. 7 presents top left isometric view of a collar insert in accordance with an exemplary implementation of the instant invention.

Referring to FIG. 7, annular ledge 42 of cap 40 additionally forms collar fixing elements 54 which are adapted to accommodate complementary structure of collar insert 60 to detachably secure cap 40 to collar insert 60. Preferably, collar fixing elements 54 include arcuate slots 55, each of which includes an insertion receptacle 56 at a first end of arcuate slot 55 and, at a second end, an end receptacle 57 which is defined as the portion of arcuate slot 55 following bump 58 in a direction of installation rotation.

Figure 8:
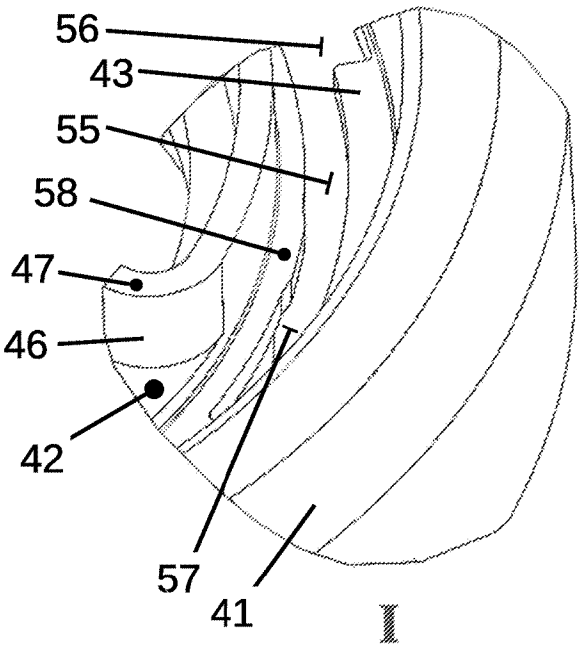
FIG. 8 presents a top left isometric view of a cap and collar insert in accordance with an exemplary implementation of the instant invention.
Figure 8:
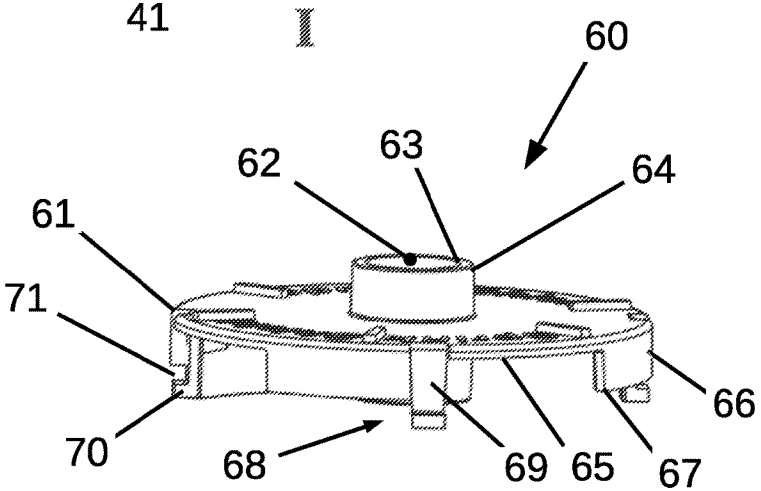

Referring now to FIG. 8, collar insert 60 includes outer edge 61. Outer edge 61 generally corresponds to an inner diameter of outer rim 41 of adapter cap 40. Collar insert 60 further includes a center aperture 62 defined by an inner edge 63, the diameter/shape of which may be selected so as to achieve optimal fit and stability with respect to an irrigation component, or element thereof, as described in more detail below. To further achieve this optimal fit and stability, a portion of collar insert 60 proximate inner edge 63 may extend upward and/or downward to form sleeve 64 thereby increasing the surface area of protection device 1 that may contact the component or element installed therein. Alternatively, as shown in FIG. 7, sleeve 64 is absent, and aperture 62 is enlarged to accommodate large diameter conduit. Collar insert 60 also includes a lower surface 65 that extends downward to form arcuate standoffs 66 each of which terminate along respective contact edges 67. In a preferred embodiment, the height of arcuate standoffs 66 is equal in magnitude to the height of arcuate standoffs 46 of cap insert 40. Lower surface 65 also includes fixing elements 68 which are shaped and positioned to be received by collar fixing elements 54 of adapter cap 40 and to thereby form a detachable connection between adapter cap 40 and collar insert 60. In a preferred embodiment, fixing elements 68 include projecting tabs 69 each terminating in an angled head 70. Each projecting tab 69 is located between two arcuate collar standoffs 66, and angled heads 70 of projecting tabs 69 extend downward beyond an imaginary plane containing contact edges 67 of arcuate collar standoffs 68.

A detachable installation of cap 40 with collar insert 60 may be achieved via a "twist-lock" arrangement. Referring now to FIGS. 7 and 8, a preferable twist-lock installation is described. Each arcuate slot 55 of adapter cap 40 receives collar projecting tabs 69 at respective insertion receptacles 56, and collar insert 60 is pressed toward cap 40 until top surfaces 71 of projecting tabs 69 clear bottom surface 44 of annular ledge 42 such that installation rotation of collar insert 40 against cap 40 is possible. At this point, each contact edge 47 of cap arcuate standoffs 46 is in contact with bottom surface 65 of collar insert 40, and each contact edge 67 of collar arcuate standoffs 66 is in contact with top surface 43 of annular ledge 42 of cap 40. A subsequent installation rotation of the collar insert with respect to the cap ultimately places each outer face of collar projecting tabs 69 in contact with outer edges of respective arcuate slots 55 as each top surface 71 of angled head 70 of projecting tabs 69 slides along bottom surface 44 of annular ledge 42 of cap 40, until projecting tabs 69 meet and squeeze past bumps 58 of arcuate slots 55. Once collar projecting tabs 69 are fully rotated past bumps 58, collar insert 60 is rotationally constrained by projecting tabs 69 being held within respective end receptacles 57 and is axially constrained by collar arcuate standoffs 66 which contact top surface 43 of annular ledge 42 at contact edges 67 as well as cap arcuate standoffs 46 which contact bottom surface 65 of collar insert 60 at contact edges 47. (Detaching collar insert 60 from adapter cap 40 is performed by executing, in reverse, the installation procedure described above).

Figure 9:
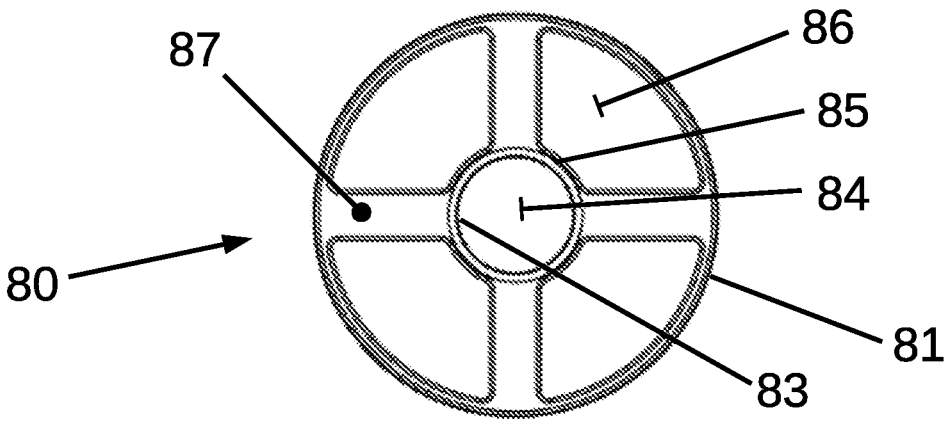
FIG. 9 presents a top plan view of a stabilizer ring in accordance with an exemplary implementation of the instant invention.
Figure 10:
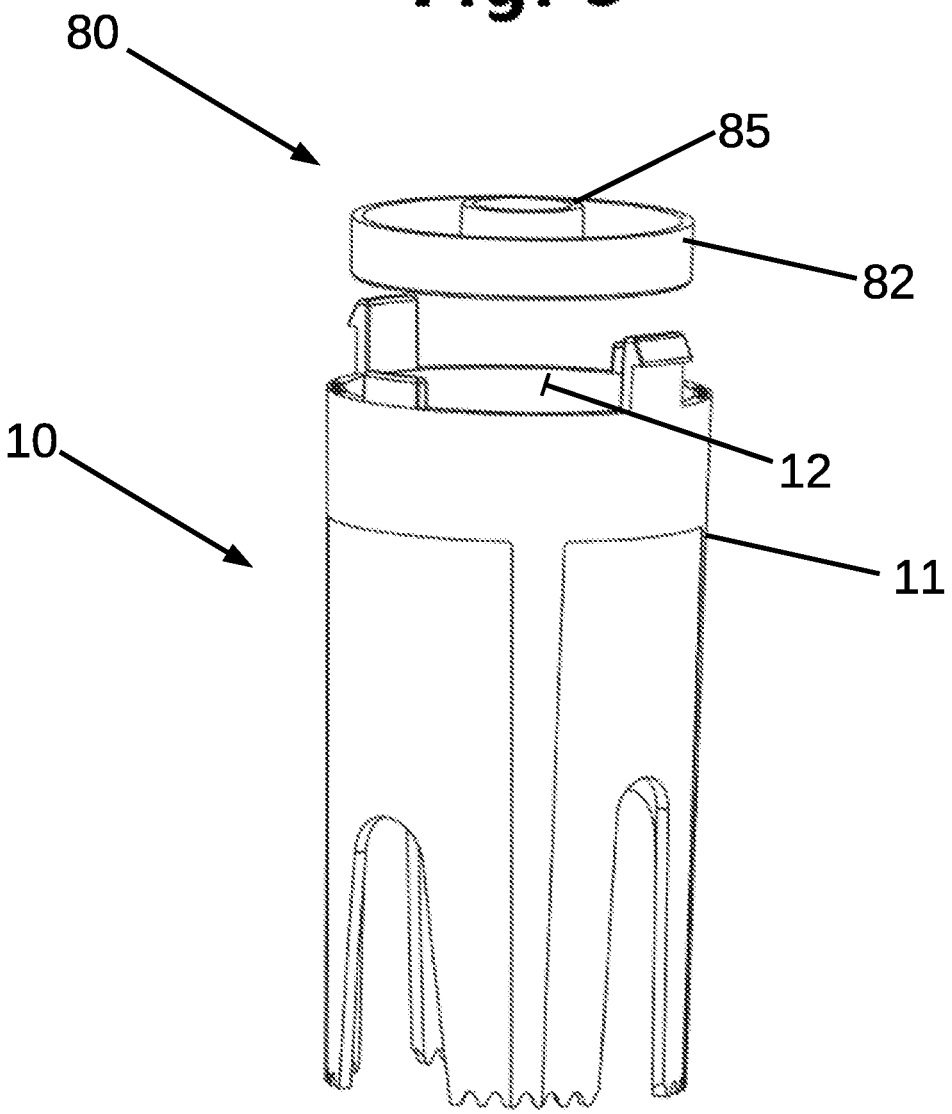
FIG. 10 presents a top left isometric view of a stabilizer ring and protector body in accordance with an exemplary implementation of the instant invention.

Referring now to FIGS. 9 and 10, stabilizer ring 80 is defined by outer edge 81 which rises to form outer rim 82. Stabilizer ring 80 moves inward from outer edge 81 to form inner edge 83, which defines center aperture 84, and rises to form inner rim 85. The material between outer rim 82 and inner rim 85 may be solid. In a preferred embodiment, voids 86 are present between outer rim 82 and inner rim 85 so as to form spokes 87. The outer diameter of outer rim 82 is preferably in a range spanning the inner diameters of top rim 13 and bottom rim 14 of protector body 10. Outer edge 81 of outer rim 82 preferably has a taper matching a taper of wall 11 of protector body 10 at a point where outer diameter of outer rim 82 is equal to an inner diameter of wall 11.

Still referring to FIGS. 9 and 10, a preferred detachable installation of stabilizer ring 80 into protection device 1 includes the steps of orienting stabilizer ring 80 with respect to protector body 10 such that a central axis of stabilizer ring 80 aligns with a central axis of protector body 10 and pressing stabilizer ring 80 downward into protector body 10 until outer rim 82 is firmly held by the interior of wall 11 of protector body 10 (i.e., an interference fit). Removal of stabilizer ring 80 is achieved by pulling stabilizer ring 80 upward toward top rim 13 of protector body 20. Use of stabilizer ring 80 in conjunction with an irrigation component is described in more detail below.

Figure 11:
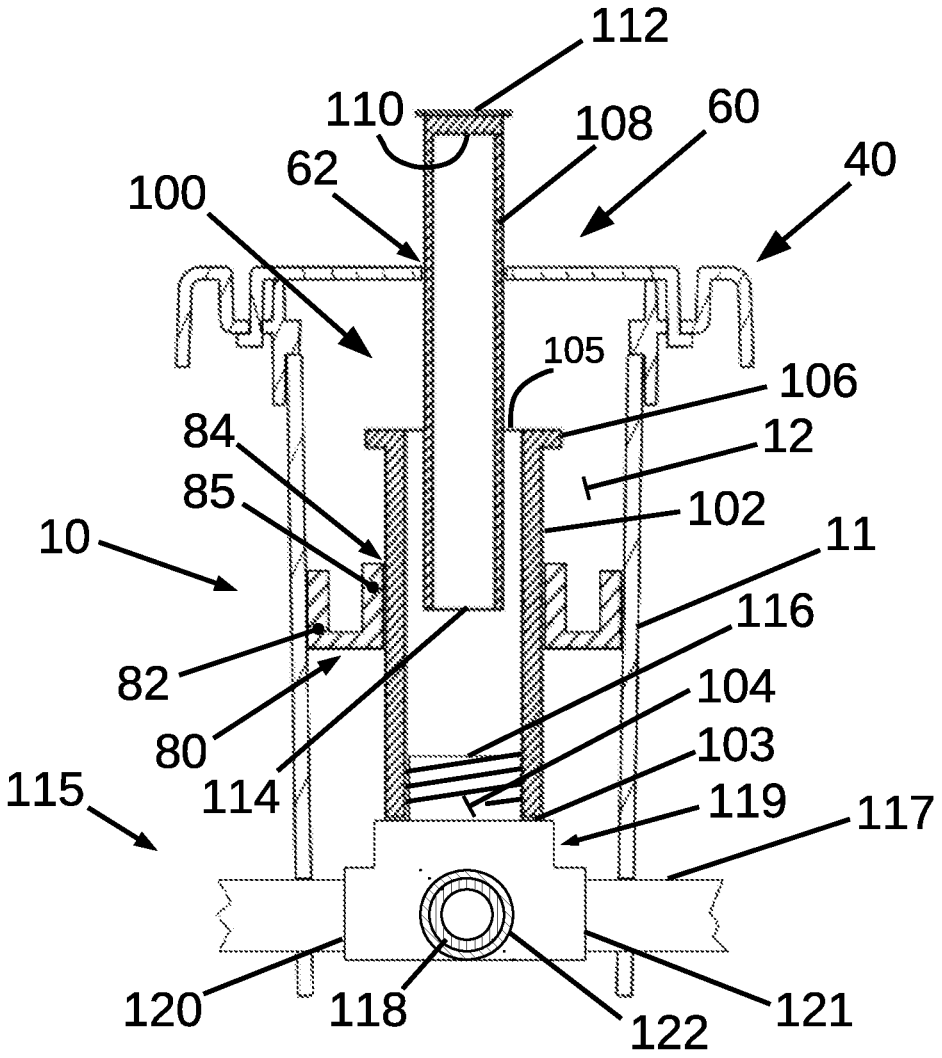
FIG. 11 presents a cross-section of a front plan view of an improved irrigation protection device having a typical in-ground sprinkler installed therein with a front plan view of water supply line components superimposed thereon.

Irrigation protection device 1 of the Instant Invention is particularly adapted for use with conventional "pop-up" sprinklers, such as sprinkler 100 in FIG. 11. Pop-up sprinklers are well known in the irrigation and sprinkler arts and typically include a main body 102 having a water inlet 104 extending through a lower surface 103 which is typically threaded or otherwise adapted for attachment to a conventional irrigation conduit end or conduit connector. At its upper end, the sprinkler main body 102 may have a flange 106, or, alternatively, a threaded reinforced cover (not shown) or the like, which are generally greater in diameter than the corresponding main body 102. The upper end of the sprinkler main body 102 has an opening 105 enabling unimpeded vertical translation of riser 108 (or any similar pop-up structure) therethrough. At its upper end, riser 108 includes a nozzle 110 that may support a water radius spray-pattern adjustment screw 112. At its lower end, riser 108 includes a riser water inlet 114.

At a lower end/surface 103, the sprinkler body 102 is connected to an external water supply line. In the example shown in FIG. 11, lower end 103 incorporates threaded water inlet 104 that is adapted to be connected to water supply line 117 via threaded adapter 116. Additional conventional elements of various conventional pop-up style in-ground sprinklers may include a body cap, wiper seal and the like, which are not shown in the accompanying drawing figures as they are well known to those skilled in the sprinkler and irrigation arts and not necessary to render the invention enabled. Similarly, various internal workings of such sprinklers, including, for example, springs, check valves, pressure activated stem cleaners, water lubricated drive mechanisms, flow adjusters and the like are not necessary to enable a complete understanding of the present invention. However, some examples of the inner workings of exemplary conventional pop-up sprinklers may be found in U.S. Pat. Nos. 4,625,914; 4,787,558; and 6,732,950 (all assigned to Rain Bird Sprinkler Manufacturing Corporation of Glendora, Calif.), the entire contents of which are incorporated by reference, herein. A few representative non-limiting examples of commercially available pop-up type sprinklers with which the present invention could be employed include RAIN BIRD brand models 1800 Professional Series Full Pattern 4-inch Pop-up Sprinkler; F4 PC Falcon 6504 Series Part Circle Rotor Pop-up Sprinkler; 1804H Half Circle Pop-Up Sprinkler; and SP25AP-25 Sure Pop Pop-Up Adjustable Pattern Sprinkler.

Referring now to FIGS. 3 and 11, a typical installation of the present invention is described in detail. Initially, dirt and debris should be removed from at least above subterranean water supply components 115, such as water supply line 117 and multi-way fitting 119. This dirt removal may be facilitated using the serrated edge 21 of protector body 10 or other suitable tool. Next, a protector body 10 is selected according to predetermined selection criteria that includes at least accommodation of one or more dimensions of a water supply line component. In the example of FIG. 11, this criterion is met by the selection of first groove profile 24 of first groove pair 22. Protector body 10 is then installed over water supply line 117 in a riding engagement manner. FIG. 11 depicts water supply line 117 entering and exiting multi-way fitting 119 at first port 120 and second port 121, and a single groove profile (e.g., first groove pair 22) is therefore sufficient to achieve a riding engagement of protector body 10 with water supply line 117. Where one or more additional water supply lines are present, such as water supply line 118 at port 122 of multi-way fitting 119, first groove profile 24 may also be utilized by additional groove pairs to maintain a riding engagement of protector body 10 with the additional water supply line(s) (e.g., where the outer diameter of the additional water supply line(s) is the same). However, in some installations, the selection of an additional groove profile distinct from the first groove profile (first groove profile 24 of first groove pair 22) may be necessary to achieve a riding engagement with the additional water supply line(s).

Where increased stability is desired, stabilizer ring 80 may be employed by placing center aperture 84 of a pre-elected stabilizer ring 80 around a portion of sprinkler 100. In a preferred embodiment, center aperture 84 of stabilizer ring 80 is placed around main body 102 of sprinkler 100, and the sprinkler 100/stabilizer ring 80 combination is pushed down into protector body 10.

Next, sprinkler 100 is installed onto water supply line 117, such as by screwing sprinkler 100 onto threaded adapter 116. In installations utilizing stabilizer wheel 80, stabilizer ring 80 is then pressed into protector body 10, over the selected portion (e.g., main body 102) of sprinkler 100, until stabilizer ring 80 is held firmly by the inner side of wall 11 protector body 10. Next, adapter cap 40 is then detachably joined with protector body 10 in the manner described hereinabove.

A specific collar insert is then selected by the user according to pre-selection criteria. In a preferred embodiment, the pre-selection criteria includes a diameter of center aperture 62 corresponding to an outer diameter of sprinkler riser 108 (or similar sprinkler structure) and the presence, or absence, of an appropriate collar insert sleeve (e.g., sleeve 64 of FIG. 8) for increased stability. Next, the collar insert selected (e.g., collar insert 60) is detachably connected to cap 40 in the manner described hereinabove.

In general, those skilled in the art to which this disclosure relates will recognize that many changes in construction and materials as well as widely differing embodiments will suggest themselves without departing from the spirit and essential characteristics of this disclosure. For example, although the preferred embodiment is described in the context of a lawn sprinkler application, other applications could benefit from having a protection device to stabilize and protect internal elements, including other piping applications (such as gas, water, sewer, ventilation) and wiring applications (cable, wire, telephone). Accordingly, the disclosures and descriptions herein are intended to be illustrative only, and not limiting, of the scope of the invention, which is set forth in the claims.

I claim:

1. A protection device for an irrigation system having at least one water line and at least one irrigation sprinkler head, the protection device comprising:

a protector body having a wall defining an interior cavity, a top rim with radially positioned upwardly projecting tabs, and a bottom rim with at least two groove pairs, wherein a first groove pair has a first groove profile, and a second groove pair has a second groove profile, the second groove profile being different from the first groove profile;

an adapter cap having an outer rim surface, an annular ledge extending inward from the outer rim surface, a bottom surface radially positioned notches, and a top surface with collar fixing elements, the adapter cap-radially positioned notches are detachably connected to the radially positioned upwardly projecting tabs of the protector body;

a collar insert having an outer edge, an inner edge defining a center aperture, and a lower surface with fixing elements detachably connected to the adapter cap collar fixing elements adjacent the annular ledge; and wherein said protector body is selectively ridingly engaged between a first riding engagement with the first pair of grooves on at least one water line or a second riding engagement with the second pair of grooves on at least one water line, based on predetermined selection criteria;

wherein the predetermined selection criteria includes which of the first pair of grooves and second pair of grooves, when in riding engagement with the at least one water line, places the adapter cap of the protection device closer to ground level.

2. The protection device of claim 1 further comprising a stabilizer ring disposed in the interior cavity of said protector body.

3. The protection device of claim 1, wherein the first and second profiles are arched profiles.

4. The protection device of claim 1, wherein the radially positioned notches are beveled notches shaped to receive the upwardly projecting tabs.

5. The protection device of claim 1, wherein the collar fixing elements are arcuate receptacles.

6. The protection device of claim 5, wherein the fixing elements are arcuate protruding tabs shaped to be received by the arcuate receptacles.

7. The protection device of claim 1, wherein the protector body has a serrated edge on the bottom rim.

8. The protection device of claim 1, wherein the protection device is made from plastic.

9. A method of using a protection device for an irrigation system having at least one water line and at least one irrigation sprinkler head, the method comprising the steps of:

placing a protector body around an irrigation sprinkler head, the protector body having a wall defining an interior cavity, a top rim with radially positioned upwardly projecting tabs, and a bottom rim with at least two pairs of grooves wherein a first pair of grooves has a first profile and a second pair of grooves has a second profile, the second profile being different than the first profile;

attaching an adapter cap to said protector body, the adapter cap having an outer rim surface, an annular ledge extending inward from the outer rim surface, a bottom surface with radially positioned notches detachably connected to the radially positioned upwardly projecting tabs of the protector body, and a top surface with collar fixing elements;

connecting a collar insert to said adapter cap, the collar insert having an outer edge, an inner edge defining a center aperture, and a lower surface with fixing elements detachably connected to the collar fixing elements of the adapter cap; and selecting placement of the protector body between a first riding engagement with the first pair of grooves on the at least one water line or a second riding engagement with the second pair of grooves on the at least one-water line, based on predetermined selection criteria;

wherein the predetermined selection criteria includes which of the first pair of grooves and second pair of grooves, when in riding engagement with the at least one water line, places the adapter cap of the protection device closer to ground level.

10. The method of claim 9, further including the step of placing a stabilizer ring in the interior cavity of said protector body.

11. The method of claim 9, wherein the first and second profiles are arched profiles.

12. The method of claim 9, wherein the radially positioned notches are beveled notches shaped to receive the upwardly projecting tabs.

13. The method of claim 9, wherein the collar fixing elements are arcuate receptacles.

14. The method of claim 13, wherein the fixing elements are arcuate protruding tabs shaped to be received by the arcuate receptacles.

15. The method of claim 9, wherein the protector body has a serrated edge on the bottom rim.

16. The method of claim 15, further including the step of using the serrated edge to loosen dirt adjacent the sprinkler head.

17. The method of claim 9, wherein the protection device is made of plastic.

18. The method of claim 17, wherein the plastic is polypropylene.

* * * * *